US006449822B1

(12) United States Patent
Gilbert et al.

(10) Patent No.: US 6,449,822 B1
(45) Date of Patent: Sep. 17, 2002

(54) RIVETING TOOL

(75) Inventors: Terence Gilbert, Welwyn Garden; John William Charles Saxon, Sawtry, both of (GB)

(73) Assignee: Textron Fastening Systems Limited (GB)

( * ) Notice: Subject to any disclaimer, the term of this patent is extended or adjusted under 35 U.S.C. 154(b) by 0 days.

(21) Appl. No.: 09/889,903

(22) PCT Filed: Dec. 6, 2000

(86) PCT No.: PCT/GB00/04614

§ 371 (c)(1),
(2), (4) Date: Oct. 16, 2001

(87) PCT Pub. No.: WO01/41953

PCT Pub. Date: Jun. 14, 2001

(30) Foreign Application Priority Data

Dec. 6, 1999 (GB) ..... 9928670

(51) Int. Cl.[7] ..... B21J 15/10

(52) U.S. Cl. ..... 29/243.521; 29/243.523; 72/391.4

(58) Field of Search ..... 29/243.521, 243.523, 29/243.524, 243.525; 72/391.2, 391.4

(56) References Cited

U.S. PATENT DOCUMENTS

| | | | | | |
|---|---|---|---|---|---|
| 3,406,557 | A | * | 10/1968 | Harris | 72/391.4 |
| 4,896,522 | A | * | 1/1990 | Rossier | 72/391.2 |
| 5,357,666 | A | * | 10/1994 | El Dessouky et al. | 29/243.521 |
| 5,452,505 | A | * | 9/1995 | Gasser | 29/243.526 |
| 6,182,345 | B1 | * | 2/2001 | Travis | 29/243.521 |

FOREIGN PATENT DOCUMENTS

| | | | |
|---|---|---|---|
| DE | 3917507 | * | 2/1991 |
| FR | 2660886 | * | 10/1991 |

* cited by examiner

*Primary Examiner*—David Jones
(74) *Attorney, Agent, or Firm*—Trexler, Bushnell, Giangiorgi, Blackstone & Marr, Ltd.

(57) ABSTRACT

A riveting tool (11) for placing a blind breakstem rivet (28), which tool comprises: a body (12, 13, 14), a nosepiece (18) removably and replaceably securable to the body (14); a drawbar (17) reciprocable with respect to the body (14) and the nose-piece (18); and stem-engaging means (22) removably and replaceably securable to the drawbar (17), in which the nosepiece (18) is readily and rapidly removable from and replaceable on the body (14), and the stem-engaging means (22) is readily and rapidly removable from and replaceable on the drawbar (17); thereby to enable the rapid removal and replacement of the nosepiece (18) and stem-engaging means (22).

11 Claims, 6 Drawing Sheets

14
17
41
22
39

14
17
22

14
17
22
35
18

14
18

RIVETING TOOL

The invention relates to a riveting tool, and more particularly to a riveting tool for placing blind, breakstem, rivets. Such a rivet comprises a generally tubular shell, and a stem extending through the shell and protruding from one end thereof. In use, the shell is inserted through suitable aligned apertures in workpieces to be joined together, and a riveting tool is applied to the rivet and is operated to place the rivet. The tool comprises a hollow nosepiece at the forward end of which is an annular anvil for contacting that end of the rivet shell from which the rivet stem protrudes through the annular anvil, and, inside the hollow nosepiece, a stem-engaging device into which protrudes at least one part of the rivet stem remote from the shell. In use, the stem-gripping device is retracted with respect to the anvil, thereby engaging the stem and applying tension to it with respect to the shell. This causes the shell to deform and rivet the workpieces together, and the part of the stem remote from the shell thereafter breaks off to leave minimal protrusion of the rivet from the workpieces.

Usually the tool comprises a body on which the nosepiece is mounted, with the anvil at the end thereof remote from the body. The stem-engaging device is mounted on the forward end of a drawbar which is reciprocable with respect to the nosepiece by means of a motor, which is commonly a pneumatic, or hydro-pneumatic or electro-hydro-pneumatic device contained within the body or part of the body.

Such rivets are called 's blind rivets's because they can be installed by access to only one side of the workpieces. An example of such rivets are those well known and readily available in many countries of the world under the registered trademark AVEX. Hydro-pneumatic tools for installing them are well known and readily available under the registered trademark GENESIS. Such a tool is described, for example GB 2301547 A, with the exception of the anvil and stem-engaging device, for which the reader is referred to, for example, GB 1 004 361.

Rivets of different sizes, i.e. of different diameters of shell and different diameters of stem, require different appropriate sizes of nosepiece anvil, and stem-engaging device respectively, to properly install them. It has therefore been usual to provide a riveting tool with a body, a motor and a drawbar, on to which a suitable nosetip and rivet-engaging device can be mounted. In prior art tools, the nosepiece is threadedly engaged with the body, and the stem-engaging device is threadedly engaged with the drawbar. Consequently, removal of the nosetip and stem-engaging device for service replacement, or for replacement by components of a different size, involves lengthy removal of the tool from active use. Under present-day production-line conditions, such lengthy 'down-time', as it is called, is not acceptable.

The present invention seeks to overcome the disadvantage, by speeding up the removal and replacement process.

The invention provides, in one of its aspects, a riveting tool as set out in claim 1 of the appended claims.

The invention also provides further preferred features as set out in claims 2 to 12 of the appended claims.

A specific embodiment of the invention will now be described by way of example and with reference to the accompanying drawings, in which:

FIG. 1 is an exterior side elevation of a blind rivet placing tool;

FIG. 2 is an axial section through the nosetip and the stem-engaging means inside it, also showing a rivet to be placed thereby, FIG. 3 is a simplified exploded elevation, illustrating the nosepiece removed from the body and the stem-engaging means removed from the drawbar, FIGS. 4A–4D are similar to FIG. 3 but at right-angles thereto, illustrating the stages in the progressive re-assembly of the various elements;

Figure 1:
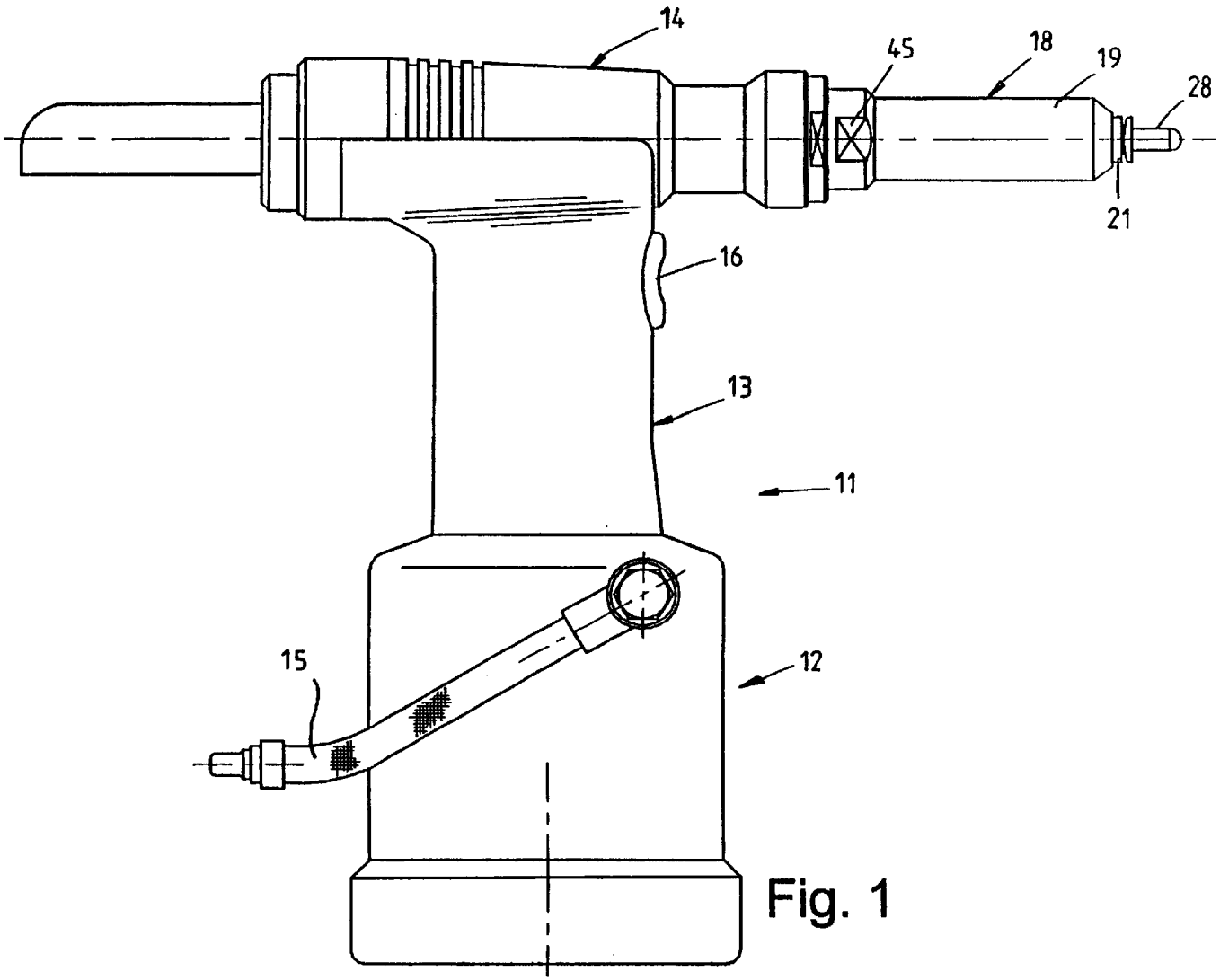

The placing tool is shown generally in FIG. 1 and comprises a body having three main parts, a lower part 12 which contains a pneumatic piston-and-cylinder device, or alternative drive means, an intermediate part 13 which provides a pistol grip for the tool and contains the first part of a hydraulic intensifier, and an upper part 14, substantially at right angles to the pistol grip, which contains a hydraulic piston-and-cylinder device. Compressed air is supplied to the tool through a connection 15, and when a trigger 16 on the pistol grip is depressed by an operator the hydro-pneumatic device is actuated to withdraw a drawbar 17 (FIG. 2) connected to the hydraulic piston. When the trigger is released, the drawbar is returned in the opposite direction by means of a spring.

Attached to the front end of the upper body part 14 is a tubular nosepiece 18, which comprises a tubular casing 19, at the forward end of which is secured an annular anvil 21. Inside the nosepiece and attached to the front end of the drawbar 17 is rivet stem-engaging means in the form of a pulling-jaw assembly 22, illustrated separately in FIG. 7. As is usual in such tools, the jaw assembly 22 comprises an outer housing 23 providing an inner tapered collet into which jaws 24 are urged by a helical compression spring 25 through a jaw pusher 26. The jaws 24 thus automatically close to grip the stem 27 of a rivet 28 when the stem is inserted through the anvil 21, as shown in FIG. 1. When the tool is actuated, the jaws are retracted with respect to the nosepiece 18 and anvil 21, so that the rivet 28 is placed, or set, by deformation of its tubular shell 29.

The construction and operation of the tool 11, as so far described above, is well known and understood in the art of blind riveting.

In such prior art tools, it is normal practice for the nosepiece to be attached to the tool body, and for the jaw assembly to be attached to the drawbar, by multiple-turn threaded engagement, as is illustrated, for example, in FIG. 1 of GB 2 301 547 A. In use of such a tool under working conditions, it is sometimes necessary to remove the jaw-assembly for service, or in order to free jammed jaws. Such removal clearly involves firstly unscrewing the nosepiece from the body to gain access to the jaw assembly inside it, and then unscrewing the jaw assembly from the drawbar in order to gain access to the jaws inside the jaw-housing. After servicing, or replacement of the jaw assembly by another one, re-assembly of the tool requires firstly re-screwing the Jaw assembly on to the drawbar, and then re-screwing the nosepiece on to the tool body. These actions take up a substantial amount of time, and such a lengthy 'down-time' is not acceptable under many present-day production line conditions.

Figure 2:
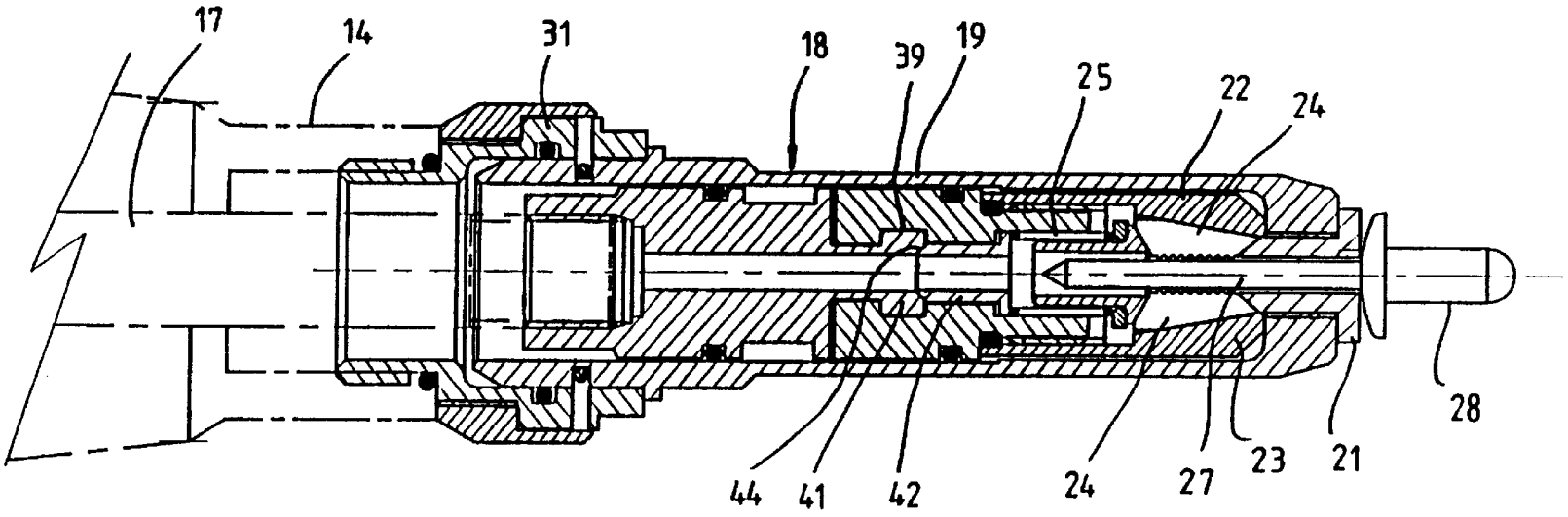
Figure 5A:
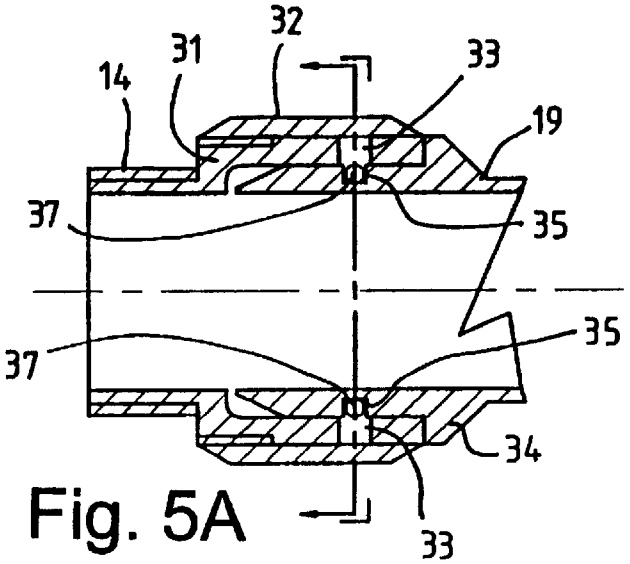
FIGS. 5A–5D are axial and cross sections which illustrate the construction and operation of the nosepiece engagement means.
Figure 5B:
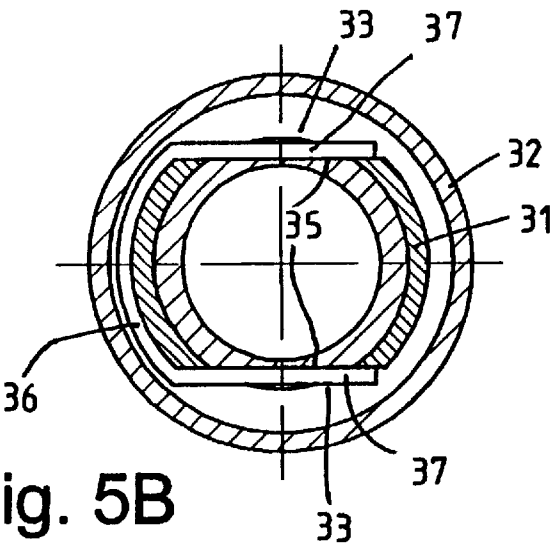

In the tool of the present example, the nosepiece is readily and rapidly removable from and replaceable on the body. To this end, as illustrated in FIGS. 2 and 5, the front end of the upper body 14, includes an adapter housing 31 on to which is threaded a covering sleeve 32. The periphery of the housing 31 is formed with two opposed slots 33 in a plane at right angles to the axis of the housing. The housing receives the rear end part 34 of the nosepiece 19, and this part is formed with two opposed grooves 35, in a plane at right angles to its axis. When the nosepiece rear end is fully inserted in the housing 31, as illustrated in FIG. 5, the grooves 35 are level with the slots 33. With the nosepiece 19 in the correct rotational relationship to the tool body and housing 31, as shown in FIGS. 5A and 5B, each groove 35 is adjacent to, and forms an extension of, one of the slots 33. Resilient retaining means for the nosepiece is provided by a U-shaped spring 36, which has two straight parallel arms 37 which are received one in each adjacent slot 33 and groove 35, as illustrated in FIGS. 5A and 5B. The sprung arms 37 engage with the grooves 35 in the nosepiece retain the nosepiece in the housing 31 and thus on the tool body.

Figure 5C:
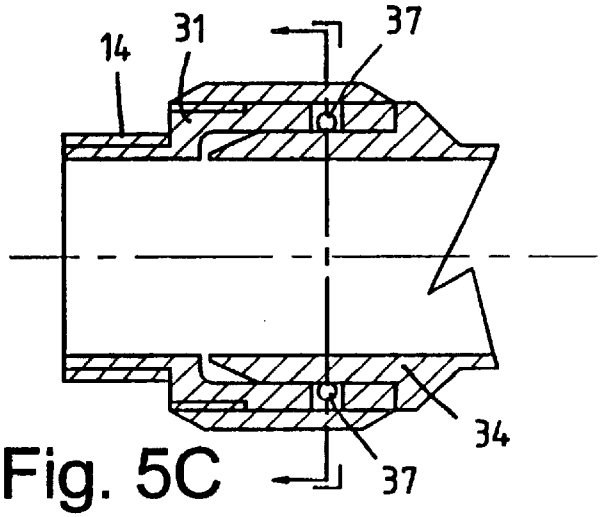
Figure 5D:
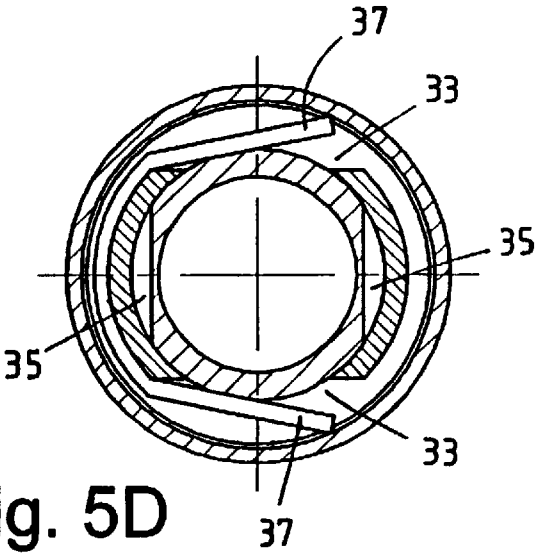
Figure 6A:
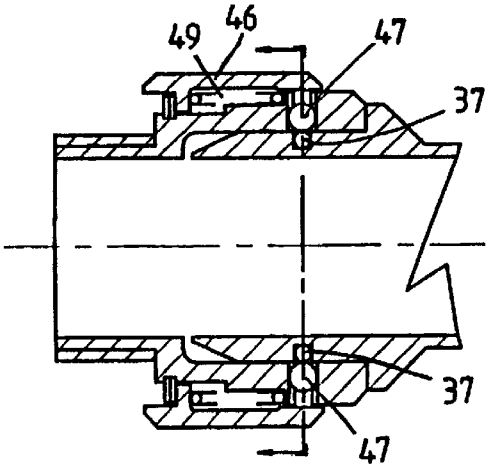
FIGS. 6A–6E are similar to FIGS. 5A–5D but illustrate a modified nosepiece engagement means incorporating the latching means.
Figure 6B:
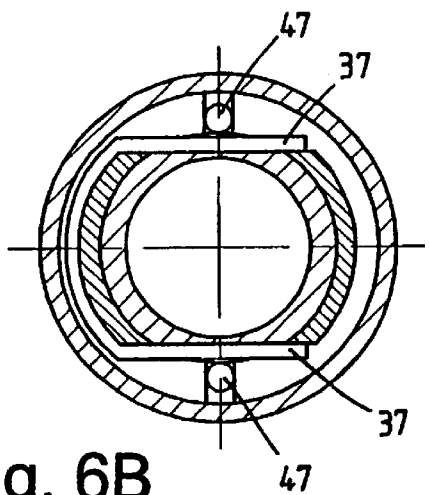
Figure 6C:
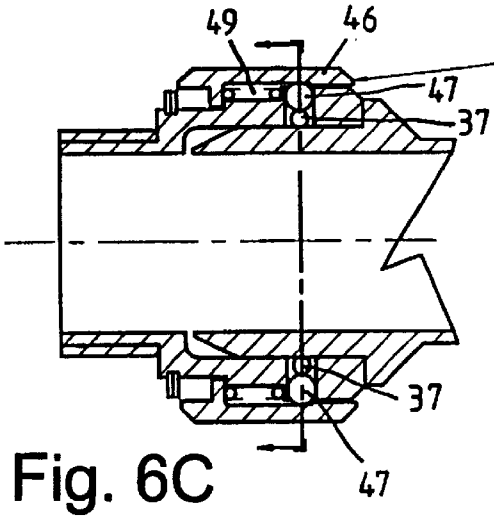
Figure 6D:
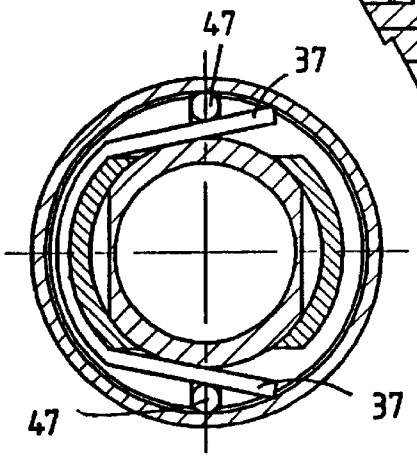
Figure 6E:
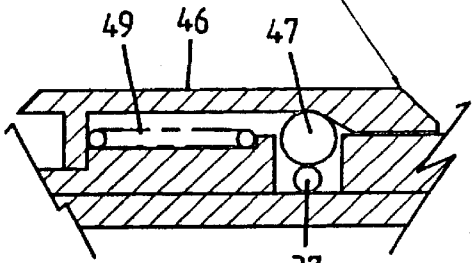
Figure 8A:
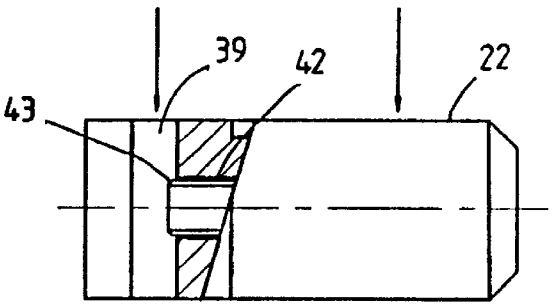
FIGS. 8A and 8B are side elevations, partly in section, through the jaw assembly and associated part of the drawbar, illustrating the action of the engagement element.
Figure 8:
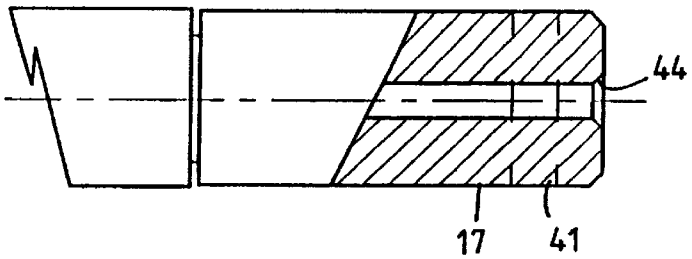
Figure 8:
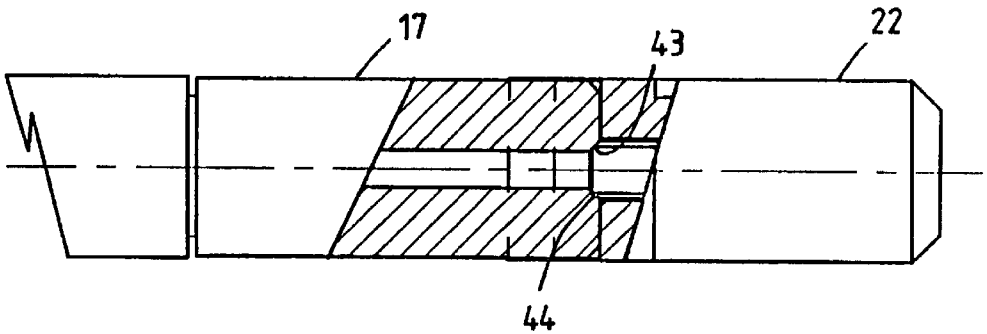

In order to remove the nosepiece 19 from the tool body, an operator, who is already holding the tool body in one hand by its pistol grip, merely grasps the outside of the nosepiece with his other hand and rotates it through 90° about its axis, in either direction. As the nosepiece 19 turns with respect to the housing 31, the full-diameter parts of the nosepiece between adjacent ends of the grooves 35 lift the arms 37 of the U-spring 36 out of engagement with the grooves 35, as illustrated in FIG. 5C and 5D, which show the nosepiece rotated through 90° from its fully engaged position of FIGS. 5A and 5B. Clearly, as the nosepiece 19 is progressively rotated from the fully engaged position of FIGS. 5A and 5B, the spring arms 37 will disengage from the grooves after substantially less than 90° rotation. However, it is better practice to use a full 90° rotation. After disengagement of the retaining means, the nosepiece is then withdrawn axially away from the tool body, to reveal the nose assembly and allow access to it.

Figure 7:
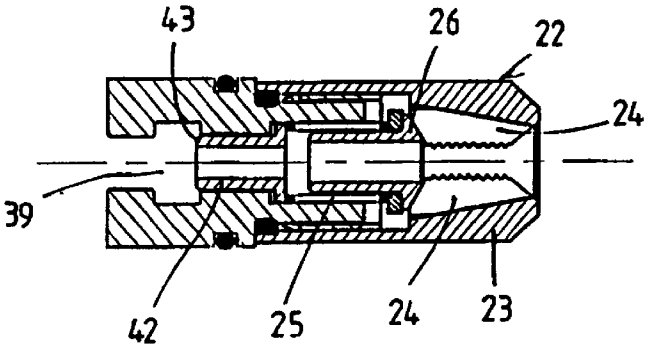
FIG. 7 is an axial section through the jaw assembly shown in FIG. 2.

In the tool of this example, the nose assembly is also readily and rapidly removable from and replaceable on the drawbar. To this end, as illustrated in FIGS. 2 and 7, the rear end face 38 of the jaw housing 22 is formed with a transverse groove 39 of T-shaped cross section. The front end of the tool drawbar 17 is provided with a corresponding spigot 41 of mating T-shaped transverse cross section. The jaw assembly 22 is secured to the drawbar 17 when the T-shaped groove 39 is fully engaged over the T-spigot 41, as illustrated in FIG. 2. Further explanation is also given below with reference to FIGS. 3 and 4. Resilient means for holding the two parts in engagement is provided by a detent sleeve 42 within the jaw housing 22. The sleeve is urged rearwardly by the rear end of the jaw-dosing spring 25, so that the chamfered rear end 43 of the sleeve 42 protrudes slightly into the front face of the T-groove 39, as shown in FIG. 7. The centre part of the front face of the T-spigot 41 is formed with a corresponding chamfered recess 44 (FIG. 2). With the two parts properly engaged, the engagement of the spring detent sleeve end 43 in the recess 44 prevents the nosepiece from accidentally falling off the drawbar. However, an operator can readily and easily remove the jaw assembly 22 from the drawbar 17 by grasping the assembly in his other hand (i.e. the hand not holding the tool) and applying a sideways force, to overcome the spring detent, and to remove the nose assembly from the drawbar.

Figure 3:
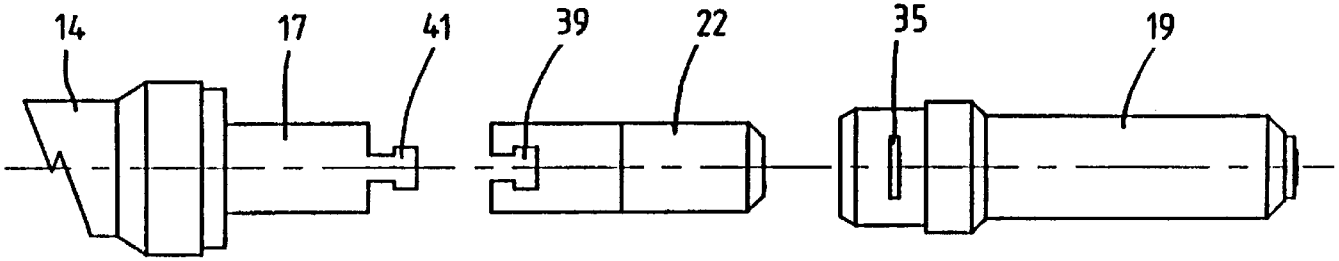

Thus, if in use of the tool it is necessary to replace the nose assembly (the most likely service requirement), the tool operator, still holding the tool in one hand by its pistol grip, uses his other hand to firstly grasp the nosepiece, turn it through 90°, remove it forwardly, release it on to a convenient surface, grasp the nose assembly and slide it sideways off the drawbar, and release it on to a convenient surface. FIG. 3 clearly illustrates in simplified form the nosepiece 19 removed from the tool body 14, and the jaw assembly 22 removed from the drawbar 17.

The reassembly process is illustrated in FIGS. 4A–4D and FIGS. 8A and 8B.

Figures 4A, 4B, 4C, 4D:
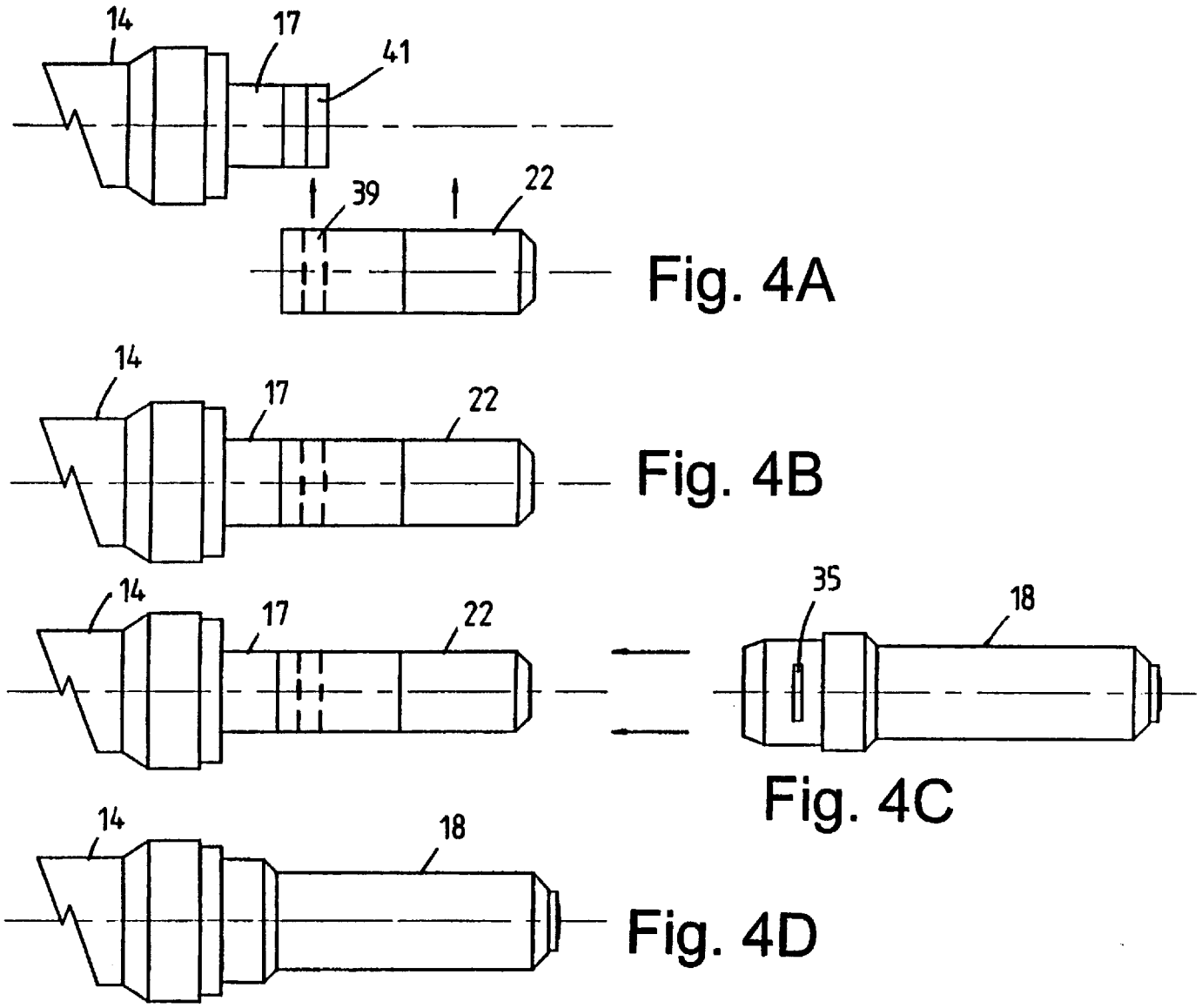

The operator picks up a replacement jaw assembly 22, aligns its T-groove 39 with the T-spigot 41 on the tool drawbar 17, and slides it sideways on to the latter as indicated by the arrows in FIG. 4A, over the detent previously described, to achieve the re-assembled condition shown in FIG. 4B. This is illustrated in greater detail in FIGS. 8A and 8B. He then picks up a nosepiece 18 (which may be either the original nosepiece or a replacement), and aligns it axially with the jaw assembly 22, as illustrated in FIG. 4C. He then slides the nosepiece over the jaw assembly 22 as shown by the arrows in FIG. 4C. He also aligns the nosepiece rotationally with the tool by aligning its grooves 35 with suitable alignment marks on the front of the tool body 14, such as opposed flats 45 (FIG. 1). The tool is then in the re-assembled condition, as illustrated in FIG. 4D, and is ready for immediate use.

It will be apparent to those skilled in the art of blind riveting that the tool of this example enables the reduction of 'down-time' by a substantial extent.

FIG. 6 illustrates an optional modification of the nosepiece retaining mechanism, in which the nosepiece is latched against rotation out of its engaged position. In this modification, the outer sleeve 32 of FIG. 1 and 5 is replaced by an axially slidable sleeve 46. Two detent balls 47 slide radially in two radial bores 48 in the housing 31, aligned with the mid-points of spring arms 37. The outer ends of the bores 48 are covered by the inner forward end of the sleeve 46, which is urged rearwardly by a spring 49. When the sleeve is thus held rearwardly, its forward end prevents the balls 48 from moving radially outwardly, sufficiently to allow the U-spring arms 37 to move out of engagement with the nosepiece grooves 35, thus preventing rotation of the nosepiece sufficiently to achieve disengagement. When the operator pushes the sleeve 46 forwards against the spring 49, an inner relieved portion 51 of the sleeve is opposite the balls 47, allowing them to move outwardly far enough to allow the spring arms 37 to release the nosepiece. This is shown in enlarged view in FIG. 6E. Such unlatching of the nosepiece engagement device, for either removal or replacement of the nosepiece, will normally require the operator to release his grip on the tool pistol grip, thus taking slightly more time, but removing the possibility of accidental release of the nosetip.

If it is desired to be able to remove and replace the jaw assembly 22 without first removing the nosepiece 18, it would be possible to provide the nosepiece with two longitudinal opposed slots in its sidewall, which would provide sufficient room to grasp the jaw assembly through the slots, slide it sideways off the drawbar, and remove it through one of the slots. Thus, in its broadest aspect, the invention is not necessarily restricted to removal and replacement of the jaw assembly only after the nosepiece has been removed.

It will be appreciated that the example tool described above enables the nosepiece and jaw assembly to be readily and rapidly removable and replaceable, by simple movements by an operator, without the use of any service tool (such as a spanner, key or the like).

The invention is not restricted to the details of the foregoing example and modifications.

What is claimed is:

1. A riveting tool for placing a blind breakstem rivet, which tool comprises:

a body; a nosepiece removably and replaceably securable to the body; a drawbar reciprocable with respect to the body and the nosepiece; and stem-engaging means removably and replaceably securable to the drawbar; in which the nosepiece is readily and rapidly removable from and replaceable on the body whilst the stem-engaging means remains secured to the drawbar; and, the stem-engaging means is readily and rapidly removable from and replaceable on the drawbar; thereby to enable the rapid removal and replacement of the nosepiece and stem-engaging means.

2. A riveting tool as claimed in claim 1, in which the stem-engaging means is removable from the drawbar only after the nosepiece has been removed from the body.

3. A riveting tool as claimed in claim 1 or claim 2, in which each of the nosepiece and the stem-engaging means is removable and replaceable as aforesaid without an operator needing to use any additional tool (such as a spanner, key of the like).

4. A riveting tool as claimed in claim 1 or claim 2, which at least one of the nosepiece and the stem-engaging means is removable and replaceable by a simple movement by an operator.

5. A riveting tool as claimed in claim 1 or claim 2, in which at least one of the nosepiece and the stem-engaging means is unlockable from, and relockable in, its operating position by simple movements by an operator.

6. A riveting tool as claimed in claim 1 or claim 2, in which at least one of the nosepiece and the stem-engaging means is retained against removal by resilient means.

7. A riveting tool as claimed in claim 6, in which the resilient means is moved from its retaining engagement by initial movement of the part to be removed.

8. A riveting tool as claimed in claim 7, in which the nosepiece is retained against removal by resilient retaining means which is disengaged from, and re-engaged with, the nosepiece by a rotating nosepiece.

9. A riveting tool as claimed in claim 8, in which the nosepiece is rotated through substantially a right angle in order to engage or disengage as aforesaid.

10. A riveting tool as claimed in claim 8, in which, when the resilient retaining means is in the engaged condition, the nosepiece is latched against rotation towards its disengaged position.

11. A riveting tool as claimed in claim 1 or claim 2, in which the stem-engaging means is removable from, and replaceable on, the drawbar by means of a simple relative movement thereto in a direction transverse to the direction or reciprocation thereof.

* * * * *